US006782988B2

(12) United States Patent
Cantacuzene et al.

(10) Patent No.: US 6,782,988 B2
(45) Date of Patent: Aug. 31, 2004

(54) INSTALLATION FOR THE DISTRIBUTION AND STORAGE OF CYLINDERS OF GAS

(75) Inventors: Serban Cantacuzene, Massy (FR); Dominique Jouvaud, Paris (FR)

(73) Assignee: L'Air Liquide - Societe Anonyme a Directoire et Consell de Surveillance Pour l'Etude et l'Exploitation des Procedes Georges Claude, Paris Cedex (FR)

( * ) Notice: Subject to any disclaimer, the term of this patent is extended or adjusted under 35 U.S.C. 154(b) by 173 days.

(21) Appl. No.: 10/136,315

(22) Filed: May 2, 2002

(65) Prior Publication Data

US 2002/0170802 A1 Nov. 21, 2002

(30) Foreign Application Priority Data

May 16, 2001 (FR) ..... 01 06456

(51) Int. Cl.[7] ..... G07D 5/00; A47B 73/00
(52) U.S. Cl. ..... 194/302; 700/214; 211/74
(58) Field of Search ..... 194/302, 352; 700/213, 214, 215, 216; 52/79.1; 340/540, 541, 542, 3.1; 211/71.01, 85.18, 74

(56) References Cited

U.S. PATENT DOCUMENTS 3,179,224 A 4/1965 Haupt, Sr. et al. ..... 194/226
3,866,173 A * 2/1975 Moorman et al. ..... 340/5.54
4,899,895 A * 2/1990 Espasandin et al. ..... 211/85.18
5,176,265 A * 1/1993 Bennett ..... 211/85.18
6,097,429 A * 8/2000 Seeley et al. ..... 348/154
6,161,706 A * 12/2000 Mc Cord ..... 211/85.18
6,662,068 B1 * 12/2003 Ghaffari ..... 700/115

FOREIGN PATENT DOCUMENTS

| | | | |
|---|---|---|---|
| DE | 196 52 147 | 5/1998 | ..... A47F/7/28 |
| EP | 0 994 432 | 4/2000 | ..... G06F/17/60 |
| EP | 1 132 872 | 9/2001 | ..... G07F/7/06 |
| WO | WO 98/27380 | 6/1998 | ..... F17C/13/02 |

* cited by examiner

*Primary Examiner*—Donald P. Walsh
*Assistant Examiner*—Mark J. Beauchaine
(74) *Attorney, Agent, or Firm*—Young & Thompson

(57) ABSTRACT

The installation comprises at least one pair of adjacent spaces, one (1) for full cylinders, and the other (2) for empty cylinders, each accessible through a door that is openable by presentation of a reader for admission to the space after validating by reading a first identification at a common identification station provided with a printer. Each space (1; 2) comprises racks (6) of opposite seats, observed by facing cameras (10, 10') permitting carrying out a continuous surveillance of available stocks.

8 Claims, 1 Drawing Sheet

INSTALLATION FOR THE DISTRIBUTION AND STORAGE OF CYLINDERS OF GAS

FIELD OF THE INVENTION

The present invention relates to installations for the distribution and storage of gas cylinders accessible directly by a user/consumer, of the type comprising at least one enclosure provided with controlled access means enclosing recesses or seats for the reception of cylinders.

Installations of this type are described in WO-A-98/27380, WO-A-99/00755 and EP-A-994432, in the name of the assignee.

BACKGROUND OF THE INVENTION

The known installations involve devices for sequentially individually blocking the cylinders and/or detection or analysis systems for the presence of cylinders that are complicated and fragile.

OBJECT OF THE INVENTION

The present invention has for its object to provide an automated installation, simplified and secured, for a low cost of capital and operation.

SUMMARY OF THE INVENTION

To do this, according to one characteristic of the invention, the space comprises at least a pair of parallel racks each comprising at least one series of seats opening respectively in first and second opposite directions, and at least one pair of cameras oriented respectively in the first and second directions so that each can take views of the seats opening toward them.

According to other characteristics of the invention:

- the installation comprises at least one pair of adjacent spaces each comprising an access door with controlled opening, the two doors of the pair of spaces being under the control of a common user identification station.
- each door is moreover placed under the control of an associate admission reader;

BRIEF DESCRIPTION OF THE DRAWINGS

Other characteristics and advantages of the invention will become apparent from the following description of one embodiment, given by way of illustration but in no way limiting, with respect to the accompanying drawings, in which.

DETAILED DESCRIPTION OF THE INVENTION

Figure 1:
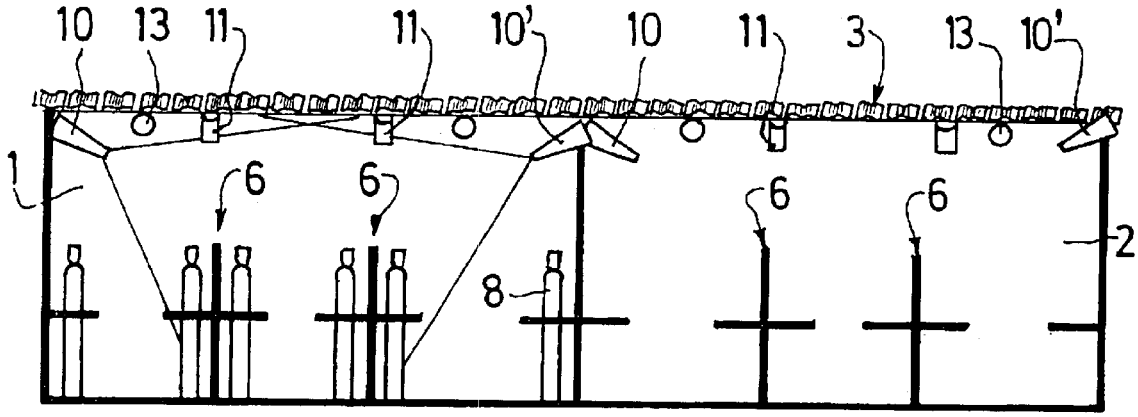
FIG. 1 is a schematic vertical cross-sectional view of an installation according to the invention.
Figure 2:
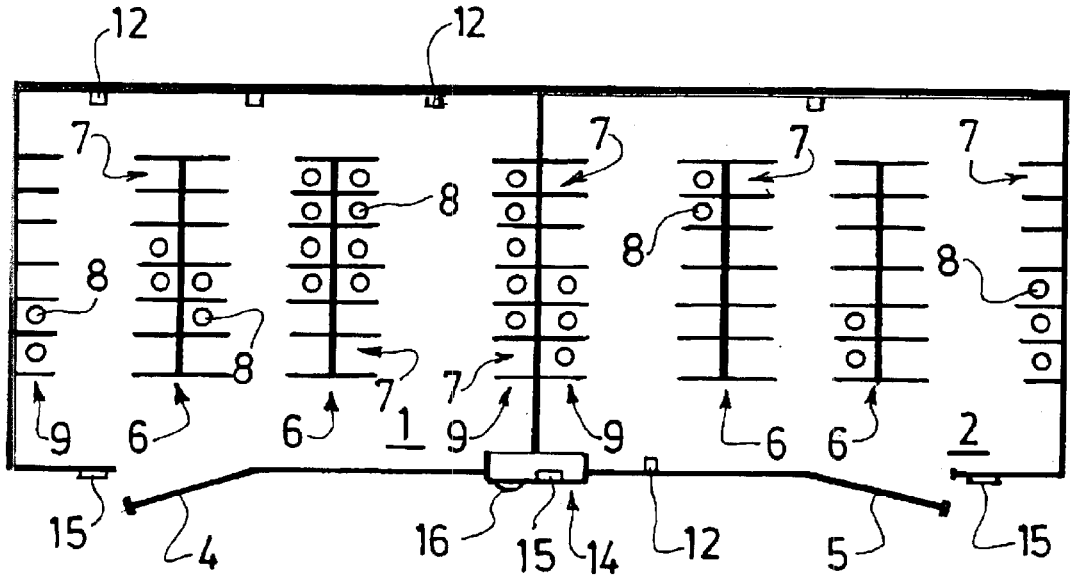
FIG. 2 is a schematic plan view of the installation of FIG. 1.

In the drawing, there is shown an installation comprising typically first and second enclosed spaces 1 and 2, adjacent in the illustrated embodiment, but not necessarily joined, covered by a roof 3 and delimited peripherally by walls provided with ventilation openings and/or assembly grills. The physical access to each space 1, 2 by a person is possible only through a pivoting or sliding door 4, 5, respectively, each provided with electromagnetically controlled closing/opening means.

In each space 1 is disposed at least one, typically two double faced parallel racks defining, on opposite sides of a rigid medial partition fixed to the ground, a series of recesses or seats 7 for the reception and lodging of cylinders 8. Each space also comprises preferably, on its sidewalls parallel to the double faced racks, single faced racks 9 comprising the same seats 7 but in a single row opening inwardly of the space.

As is better seen in FIG. 1, each space comprises at least one pair (typically two pairs) of facing cameras 10 and 10' having in their field of view, for the left side camera (10) in FIG. 1 all the seats opening to the left of the space, and for the camera located on the right side (10') in FIG. 1, all the seats opening to the right.

Each space 1, 2 moreover comprises detectors of presence or movement within the space, of the volumetric type 11 and/or with a light ray 12, coupled to visible and/or sonic alarms on site and to a telesurveillance station controlling several sites. Each space 1, 2 moreover comprises its own lighting means 13.

According to one aspect of the invention, each space 1, 2 is dedicated, one to full cylinders (space 1 in FIG. 1) at the disposal of users, the other (space 2 in FIG. 1) for the return of empty cylinders brought back by the users. Access to the spaces is hence decoupled and controlled, on the one hand, by a common identification station forming a user interface 14, and by a proximity reader 15 for each door 4, 5. A central station 14 comprises a card reader and/or an acquisition keyboard 15 and a printer 16 to deliver a delivery slip.

A typical sequence of using the installation which has been described, is as follows:

- The client arrives to get commercial gas by identifying himself at the central identification station 14 with the help of his client badge and/or by entering his secret code.
- This identification activates the recognition of the client access bade, supplied during its first inscription at the gas distribution company and which he will wear about his neck or fixed to his breast pocket, readable "on the fly" by approaching the access reader 15, thereby permitting the client to keep his hands free for use, preferably gloved to handle the cylinders both at the entry and at the exit of the spaces 1 and 2.
- Upon thus approaching the reader 15 of the access door 5 at the space for returning empty cylinders or the entry reader 15 of the door 4 for access to the full cylinder spaces, the identification of the access badge causes illumination of the lights 13 of the space in question, the test of operation of the cameras 10 and 10' of said space (to detect possible malfunction of one of these two cameras), the recordation of an image of the stock of cylinders in the store, for processing the image and computing the stock, the test of comparison of the stock thus computed with the last known stock, by the system (calculated during the exit of the preceding user), the deactivation of the intrusion alarms and the activation of a timer connected to the presence detection.

Once this sequence is over, of a variable duration (typically less than 30 seconds), the client can carry out in any desired order one or several of the following actions:

- picking up one or several full cylinders in the storage space for full cylinders 1;
- returning one or several empty containers into the storage space for the return of empty cylinders;
- consulting the information concerning it and printing it on the printer of the central station 14.

The transaction is typically over when the client returns his identification badge a second time to the central station 14, which triggers the following closure sequence:

- the test of detection of a presence of a person in one of the spaces 1 and 2 (to verify that there is no one in the spaces)
- the locking of the doors 4 and 5 and the deactivation of the access readers 15 (to ensure that no one else can enter the spaces without preliminary identification)
- the taking of images of the racks 6 and 8 in the spaces 1 and 2, the computation of the stocks in these spaces, the computation of the operations carried out by the client by comparison with the preceding stock (cylinders picked up and cylinders returned), a test of the nature of the operations (to detect an illegal operation: for example, taking an empty cylinder or a cylinder returned into the space for full cylinders),
- safeguarding the data and alarm in the case of nonconforming operations, and printing the delivery slip and/or the transportation manifest for the cylinders
- analyzing the stocks of the distributor and having recourse to the distributor in the case of insufficient residual stocks in the space 1
- activation of the intrusion alarms and activation of the badge reader of the central station 14 awaiting the arrival of another user client.

In the case in which the client leaves after having exchanged cylinders without validating a second time his identification badge at the central station 14, the absence of the presence of a person in the spaces will trigger at the end of a predetermined duration, typically of the order of 10 minutes of inactivity, the same operations as above except for printing the delivery slip which will be in this case sent to the absent-minded customer.

As will be understood from the above, the installation according to the invention prevents the user from becoming confused as to whether full or empty cylinders are in the same space and eliminates the sequences of restoration, the actions of the client being adapted to be carried out in no matter what order: return of empty cylinders and then picking up full cylinders, or vice versa, with moreover the possibility of consulting the menu of gases at the central station to seek a substitute product in the case of an insufficient stock on hand of a certain product. Thanks to eliminating individual mechanical systems for locking the cylinders, the client can have free and easy access to all the full cylinders in the space 1 as soon as his access to this latter has been authorized. The printing of a delivery menu, preferably in A4 format, permits having a manifesto for the transportation of the cylinders (required by national rules) as well as proof of the transaction carried out (for the account of the client).

Moreover, the presence of cameras 10, 10' and of presence detectors 11, 12 ensures, at lowest cost, active security based on dissuasion. Thus, the use of presence detectors permits identifying the presence of an intruder (who has not previously been identified), photographing him with the cameras, then assuring that all the users have left the spaces before the end of the transaction, which permits, as mentioned above, triggering the end of this transaction in the case of prolonged inactivity, when the user leaves without formally concluding his transaction at the central station.

Finally, the use of cameras facing each other and double faced racks permits having a compact solution at low cost, permitting particularly duplicating the cameras and the video cards so as to provide, thanks to this redundancy, against the risk of breakdown of one of these pieces of equipment.

Although the invention has been described with respect to a particular embodiment, it is not thereby limited but is susceptible to modifications and variations which will be apparent to one skilled in the art within the scope of the following claims.

What is claimed is:

1. Installation for the distribution and storage of cylinders of gas, comprising at least one enclosed space provided with controlled access means enclosing seats for the reception of cylinders, characterized in that the space (1; 2) comprises at least one pair of parallel racks (6; 9) each comprising at least one series of seats (7) opening respectively in first and second opposite directions, and at least one pair of cameras (10, 10') oriented respectively in the first and second directions to take, each one, views of the seats (7) opening toward them.

2. Installation according to claim 1, characterized in that it comprises at least two double faced racks (6).

3. Installation according to claim 1, characterized in that the cameras (10, 10') are connected to the common identification station (14).

4. Installation according to claim 1, characterized in that each space (1; 2) comprises at least one presence detector (11, 12).

5. Installation according to claim 1, characterized in that it comprises at least one pair of said adjacent spaces (1; 2) each comprising an access door (4; 5) with controlled opening, the two doors (4; 5) of the pair of spaces being under the control of a common user identification station (14).

6. Installation according to claim 5, characterized in that each door (4; 5) is moreover under the control of an associated admission reader (15).

7. Installation according to claim 6, characterized in that the controlled access means comprise a first identifier for the identification at the common identification station (14) and a second identifier for identification at the admission reader (15).

8. Installation according to claim 7, characterized in that the common identification station (14) comprises a printer of deliver slips (16).

* * * * *